US005087076A

United States Patent [19]

Fagot et al.

[11] Patent Number: 5,087,076

[45] Date of Patent: Feb. 11, 1992

[54] SKI POLE

[75] Inventors: Jacques Fagot, Saint Jean De Moirans; Claude Gobis, Voiron, both of France

[73] Assignee: Skis Rossignol SA, France

[21] Appl. No.: 685,143

[22] Filed: Apr. 15, 1991

[30] Foreign Application Priority Data

Apr. 20, 1990 [FR] France ..... 90 05297

[51] Int. Cl.[5] ..... A63C 11/22

[52] U.S. Cl. ..... 280/819; 280/821

[58] Field of Search ..... 280/816, 819, 821, 822, 280/813; 135/65, 66, 76

[56] References Cited

U.S. PATENT DOCUMENTS 3,561,782 2/1971 Tyrack ..... 280/816
4,597,589 7/1986 Fujii et al. ..... 280/821

FOREIGN PATENT DOCUMENTS 307291 5/1973 Austria .
1395793 7/1965 France .
2509186 1/1983 France ..... 280/821
2630342 10/1989 France .

*Primary Examiner*—Andres Kashnikow
*Assistant Examiner*—Richard Camby
*Attorney, Agent, or Firm*—Parkhurst, Wendel & Rossi

[57] ABSTRACT

A ski pole including a cranked/bent rod member having one end which is inserted into a cavity of a handle and another end which receives the ring or bail. The cavity of the handle is inclined by an angle α relative to the longitudinal axis of the handle. The handle includes a device for providing free rotation of the rod member relative to the handle member and a device for locking the rod member in a selected rotational position.

9 Claims, 3 Drawing Sheets

SKI POLE

BACKGROUND OF THE INVENTION

The invention relates to a new ski pole.

As it is well known, a ski pole is basically formed of a rod and a handle having a cavity that is aligned in the longitudinal axis of the handle. The upper end of the rod is inserted, generally by force or by assembling (gluing-screwing-molding from a casting), into the cavity of the handle. The lower end of the rod receives the ring or bail.

In modern skiing, particularly in slalom, it is known to use poles in which the point is not placed in the prolongation of the axis of the handle, so as to facilitate placement of the point in front of the pole, to the height of the showels without exaggerating the flexion of the handle of the skier and equally for improving the thrust of the runner at the start of the run.

Practically, there are already two solutions which permit such a result to be obtained. French A 2,517,551 and FR 2,509,186 propose to offset the axis of the handle relative to the axis of the rod, either by bending (cranking) the rod at a point S, or by using an offset handle.

In another solution, described in FR-A-1,395,793, called "angular correction", the bending from the top of the rod to the level of its fitting into the cavity of the handle forms an angle between the axis of the rod and the axis of the handle.

In both of the above proposed solutions, the point of the pole is no longer in the prolongation of the axis of the handle, which permits the above-mentioned advantages for slalom practice to be obtained.

On the other hand, in practice of leisure skiing, it is preferable to have a straight pole. This again, imposes the need to have several types of poles as a function of the considered practice.

SUMMARY OF THE INVENTION

The invention mitigates the above-discussed inconveniences. The present invention provides a ski pole that permits, in any case, a better slalom practice, as well as equally facilitating leisure skiing.

An object of the present invention is to provide a ski pole formed of a bent rod, one end of which is inserted in a cavity foreseen for this purpose in a handle. The cavity of insertion of the rod, arranged in the handle, is inclined relative to the longitudinal axis of this handle. The handle has means for giving the rod freedom to rotate relative to the handle, and means for locking the rod into a chosen position in the handle.

Advantageously, in practice the angle of inclination of the cavity formed in the handle, relative to the longitudinal axis of the handle, is equal to the angle formed by the two parts of the bent rod. This angle ranges between 1° and 6°, preferably 3°. The top of the bend, formed by the two parts of the rod, levels with the base of the handle. The means of joining, removable from the upper end of the rod into the cavity of insertion, are formed by a ratchet or an ergot associated with a button, pins, billets actuated by a compression spring, notches, and the like.

Another object of the present invention is to provide a ski pole wherein the angles of inclination of the cavity of insertion provided in the handle and the two parts of the cranked (bent) rod, are not of the same value, and the top of the crank (bend), formed by the two parts of the rod, is placed, after attachment, nearly below the base of the handle, which permits the thus formed rod to be either axially offset or in angular correction, according to the selected position of the rod.

The manner of how the invention can be realized and the advantages which ensue from it will be better shown by the following example as explained with reference to the attached drawings.

DETAILED DESCRIPTION OF THE INVENTION

Figure 1:
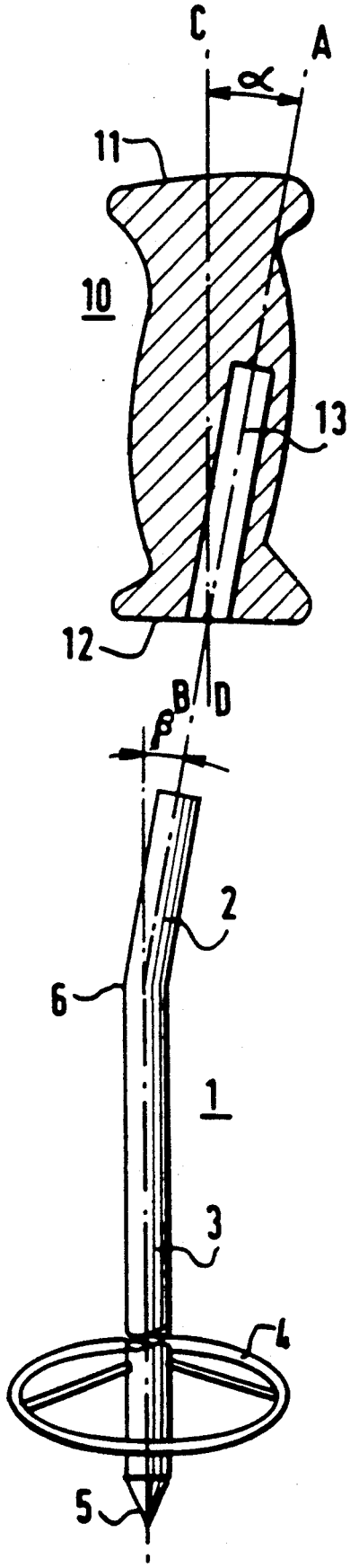
FIG. 1 represents in an exploded view a ski pole according to the invention.

FIG. 1 shows one embodiment of the ski pole according to the invention, which comprises a rod 1, formed of any known material for this application, mainly of a metal tube. Basically, the rod is bent and comprises two parts, i.e., an upper portion 2 and a lower portion or body 3 forming between them an angle $\beta$. The lower portion 3 receives at its end a ring or bail 4 and a point 5. The angular transition between portions 2 and 3 occurs at region 6, which is the top portion of lower portion 3 and the bottom portion of upper portion 2. Portions 2 and 3 are joined at region 6.

In an already known way, the ski pole comprises equally a handle 10, advantageously made of plastic material. The handle 10 comprises a top 11 and a base 12, as well as a cavity 13 in which the upper cranked (bent) end 2 of the rod 1 is inserted. According to the invention, the longitudinal axis A of this cavity 13 is inclined by an angle $\alpha$ relative to the longitudinal axis C of the handle. In a preferred form of the invention, the two angles $\alpha$ and $\beta$ are equal and range between 1° and 6°, preferably about 3°.

Figure 2:
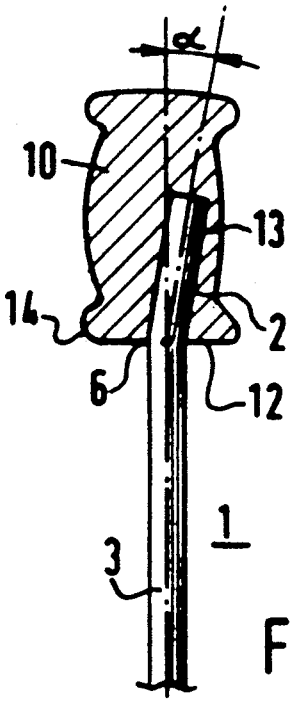
FIG. 2 and 3 show respectively the ski pole of the present invention after its fitting into the handle so that the top of the crank (bend), formed by the two parts of the rod levels with the base of the handle according to the different positions permitting the practice of leisure skiing (FIG. 2) as well as slalom, (FIG. 3), respectively.

In a first embodiment of the invention, shown in FIG. 2, the top 6 of lower portion 3 levels with the base of the handle 12, near to a front face 14 of the handle. It follows that the two angles $\alpha$ and $\beta$ subtract or annul straight position wherein the axes of the rod and of the handle are merged which is favorable for practicing leisure skiing.

Figure 3:
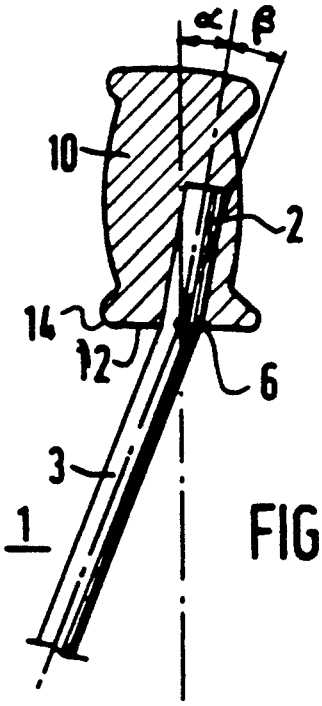

In the embodiment shown in FIG. 3, the rod 1 has been rotated 180°. The top 6 of the lower part 3 is then placed behind the handle. It follows that the two angles $\alpha$ and $\beta$ are additive, and that the end of the pole is strongly displaced to the front which is favorable for slalom practice.

Figure 4:
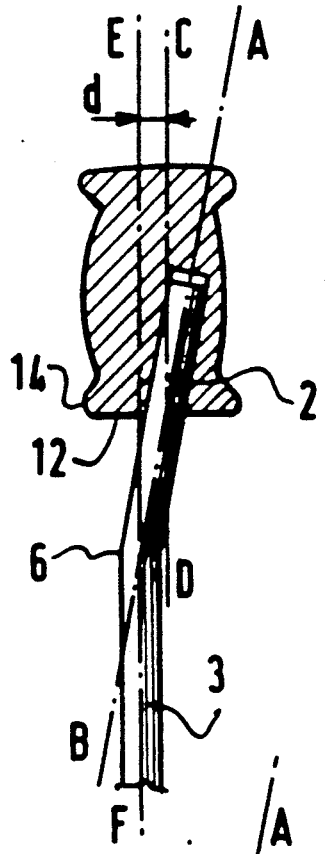
FIGS. 4 and 5 show this pole after fitting the handle so that the top of the crank, formed by the two parts of the rod, is placed below the base of the handle.
Figure 5:
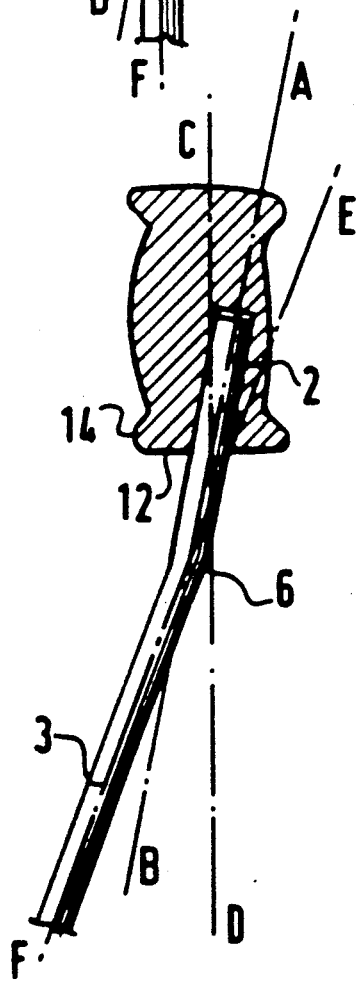

In two embodiments shown in FIGS. 4 and 5, region 6, which is the top of lower portion 3 and the bottom of upper portion 2 of rod 1, is spaced below the base 12 of the handle, for example, a distance of 100 mm.

Such spacing with an orientation of the rod that is identical with the one described in FIG. 2, provides an axial offset between the axes C of the handle and E of the lower part 3 of the rod. Such spacing with an orientation of the rod similar to the one described in FIG. 3, also provides increased angular correction.

Figure 6:
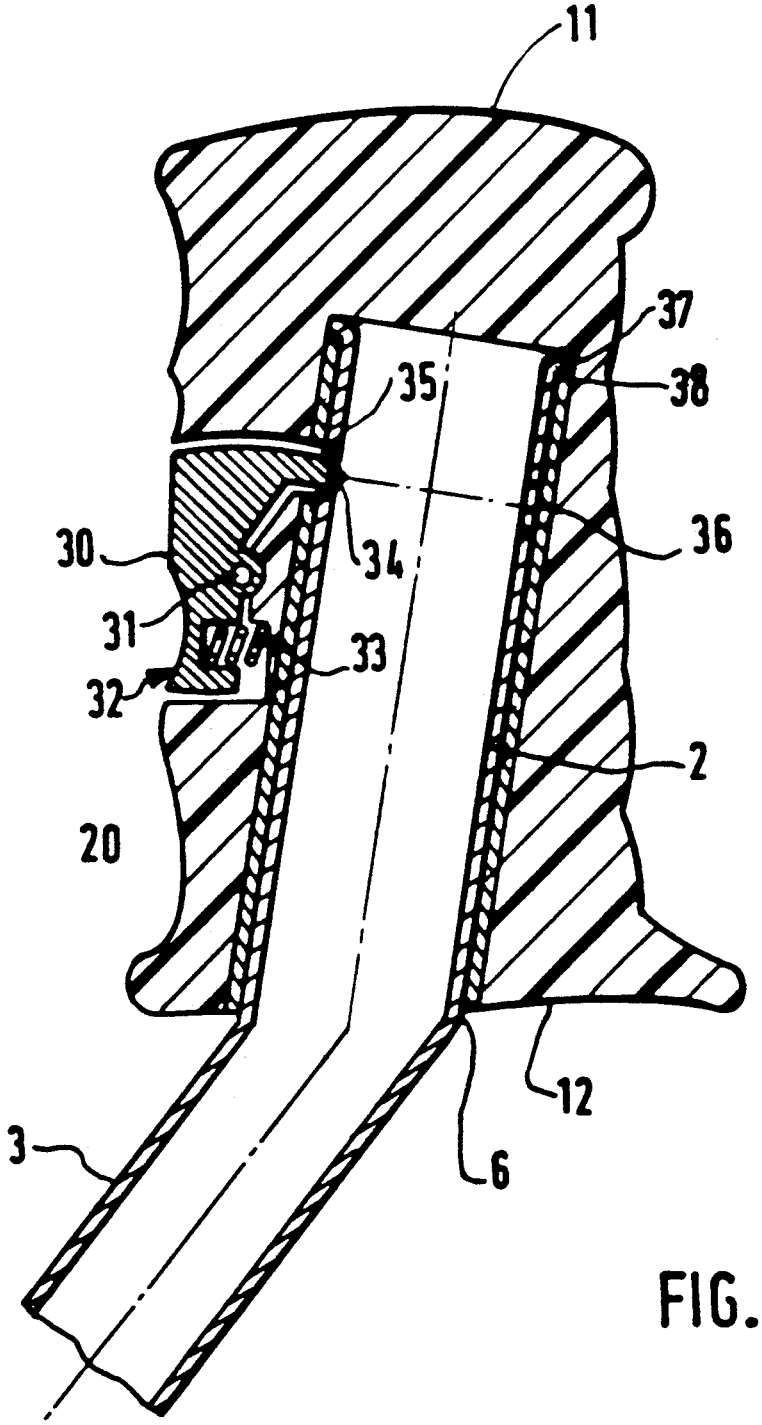
FIG. 6 represents means of removable interlocking of the upper end of the rod with the handle.

FIG. 6 illustrates means for joining the handle on the rod comprising a ring 20 of a material having a low friction coefficient, such as nylon, tetrafluorethylene, bronze, and the like, which permits the rod to turn in the inside of the handle 10. In order to avoid removal of the rod from the handle during rotation, the end of this rod has a collar flange 37 that engages on a top 38 of the ring 20. This ring 20, formed by one or several parts, is fixed by all appropriate means inside the cavity 13 of the handle. A trigger/catch 30, articulated at 31 by leaning against the base 32, permits disengagement of a finger member 34 from its orifice 35 formed in the top of the rod. The rod can then be turned by 180, in order to present the orifice 36 in front of the finger member 34. A return spring 33 maintains the trigger/catch in locking position.

What is claimed is:

1. A ski pole comprising:

a bent rod member comprising a first substantially straight portion and a second substantially straight portion, an axis of the first portion forming an angle $\beta$ with respect to an axis of the second portion;

a handle member comprising :

a cavity formed therein, said cavity being inclined at an angle o with respect to a longitudinal axis of said handle member, and said cavity housing at least a portion of the first portion of said rod member, means for providing free rotation of said rod member relative to said handle member, and means for lockign said rod member in a selected rotational position.

2. The ski pole of claim 1 wherein said angle $\alpha$ is equal to said angle $\beta$.

3. The ski pole of claim 2, wherein said angle $\alpha$ is different from said angle $\beta$.

4. The ski pole of claim 2, wherein said angles $\alpha$ and $\beta$ range between 1° and 6°.

5. The ski pole of claim 4, wherein said angles $\alpha$ and $\beta$ are about 3°.

6. The ski pole of claim 1, wherein the first portion of said rod member is substantially entirely encompassed within said cavity of said handle member.

7. The ski pole of claim 1, wherein a portion of the first portion of said rod member adjacent the second portion of said rod member extends beyond a lower end face of said handle member.

8. The ski pole of claim 1, wherein the top of the crank formed by the first and the second portions is placed, after attachment, nearly below the base of the handle.

9. The ski pole of claim 1, wherein the means for locking said rod member in a selected rotational position are selected into the group comprising a ratchet, an ergot associated with a button, pins, billets actuated by a compression spring and notches.

* * * * *